US010236617B2

(12) United States Patent
Hsu et al.

(10) Patent No.: US 10,236,617 B2
(45) Date of Patent: Mar. 19, 2019

(54) SOCKET EQUIPPED WITH LINKED CAP PAIR

(71) Applicant: FOXCONN INTERCONNECT TECHNOLOGY LIMITED, Grand Cayman (KY)

(72) Inventors: Shuo-Hsiu Hsu, New Taipei (TW); Chang-Long Zheng, Kunshan (CN); Qi-Jin Yi, Kunshan (CN); Fu-Jin Peng, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/007,989

(22) Filed: Jun. 13, 2018

(65) Prior Publication Data

US 2018/0358734 A1 Dec. 13, 2018

(30) Foreign Application Priority Data

Jun. 13, 2017 (CN) ..... 2017 1 0442467
Sep. 18, 2017 (CN) ..... 2017 2 1191255 U

(51) Int. Cl.
*H01R 13/00* (2006.01)
*H01R 13/514* (2006.01)
*H01R 12/71* (2011.01)

(52) U.S. Cl.
CPC ..... *H01R 13/514* (2013.01); *H01R 12/716* (2013.01)

(58) Field of Classification Search
CPC ..... H01R 13/514; H01R 12/716; H01R 13/5213; H01R 13/6595; H01R 12/1416; H01R 12/7023; H05K 7/1007; H05K 7/1061; H05K 7/1053; G06F 12/1416
See application file for complete search history.

(56) References Cited

U.S. PATENT DOCUMENTS 6,821,127 B2 11/2004 Lin et al.
7,534,114 B2 5/2009 Liao
8,998,623 B2 4/2015 Hsu
9,131,613 B2 * 9/2015 Hsu ..... H05K 7/1061
9,214,764 B2 12/2015 Hsu
9,385,444 B2 7/2016 Krithivasan et al.
9,426,917 B2 8/2016 Hsu
9,450,361 B2 * 9/2016 Yeh ..... H01R 12/7023
(Continued)

FOREIGN PATENT DOCUMENTS

CN 2520584 Y 11/2002
CN 202042684 U 11/2011

*Primary Examiner* — Jean F Duverne
(74) *Attorney, Agent, or Firm* — Wei Te Chung; Ming Chieh Chang

(57) ABSTRACT

An electrical connector includes a pair of housing units side by side arranged with each other and equipped with the corresponding contacts, respectively. A pair of protection caps are assembled to the corresponding housing units horizontally in opposite directions, respectively. A linking part is mounted upon the pair of caps with a rigid suction region thereof in a symmetrical manner. The linking part is downwardly mounted upon the pair of caps with corresponding standoffs to space the main part of the linking part from the caps in the vertical direction so as not to block the related heat dissipation.

15 Claims, 13 Drawing Sheets

(56) References Cited

U.S. PATENT DOCUMENTS

| | | | | |
|---|---|---|---|---|
| 2008/0189486 | A1* | 8/2008 | Nguyen | G06F 12/1416 711/115 |
| 2009/0061652 | A1* | 3/2009 | Fan | H01R 13/6595 439/41 |
| 2009/0120303 | A1* | 5/2009 | Popeil | A47J 37/1209 99/403 |
| 2009/0325409 | A1* | 12/2009 | Hsu | H05K 7/1053 439/135 |
| 2013/0005162 | A1 | 1/2013 | Mallik et al. | |
| 2014/0235098 | A1* | 8/2014 | Hsu | H05K 7/1007 439/577 |
| 2016/0022374 | A1* | 1/2016 | Haider | A61B 17/17 606/96 |
| 2018/0175538 | A1* | 6/2018 | Wu | H01R 13/5213 |

* cited by examiner

SOCKET EQUIPPED WITH LINKED CAP PAIR

1. FIELD OF THE INVENTION

The present invention relates to an electrical connector, and more particularly to an electrical connector having the paired units and further equipped with the paired caps for pick-and-place mounting upon the printed circuit board.

2. DESCRIPTION OF RELATED ARTS

A pick-up or protection cap is popularly used with an electrical connector for mounting such a connector upon the printed circuit board. Understandably, because the contact amount increases and the housing is inevitably dimensionally enlarged, a warpage problem may occur. Therefore, an electrical connector has a set of housing including more than one units as a result. U.S. Pat. No. 9,385,444 discloses a pair of caps used with a pair of housing units. Anyhow, the cap unit and the associated socket unit are not properly linked with the other cap and its associated socket unit either during shipping or mounting disadvantageously.

Therefore, an electrical connector with improved structure to unify the pair of caps is desired.

SUMMARY OF THE INVENTION

An electrical connector includes a pair of housing units side by side arranged with each other and equipped with the corresponding contacts, respectively. A pair of caps are assembled to the corresponding housing units horizontally in opposite directions, respectively. A linking part is mounted upon the pair of caps with a rigid suction region thereof in a symmetrical manner. The linking part is preferably downwardly mounted upon the pair of caps with corresponding standoffs to space the main part of the linking part from the caps in the vertical direction so as not to block the related heat dissipation. A plurality of holes for heat dissipation are formed in the cap. A plurality of holes for heat dissipation are formed in the linking part.

The linking part may be a flexible tape rather than a rigid structure. An auxiliary fixture forms a pair of receiving rooms with a divider therebetween to receive the pair of socket units with the associated caps, respectively for assisting attaching the tape upon the caps. A rigid dual-suction region is provided on the pair of caps instead of on the linking part.

Other advantages and novel features of the invention will become more apparent from the following detailed description of the present embodiment when taken in conjunction with the accompanying drawings.

DETAILED DESCRIPTION OF THE PREFERRED EMBODIMENT

Figure 1:
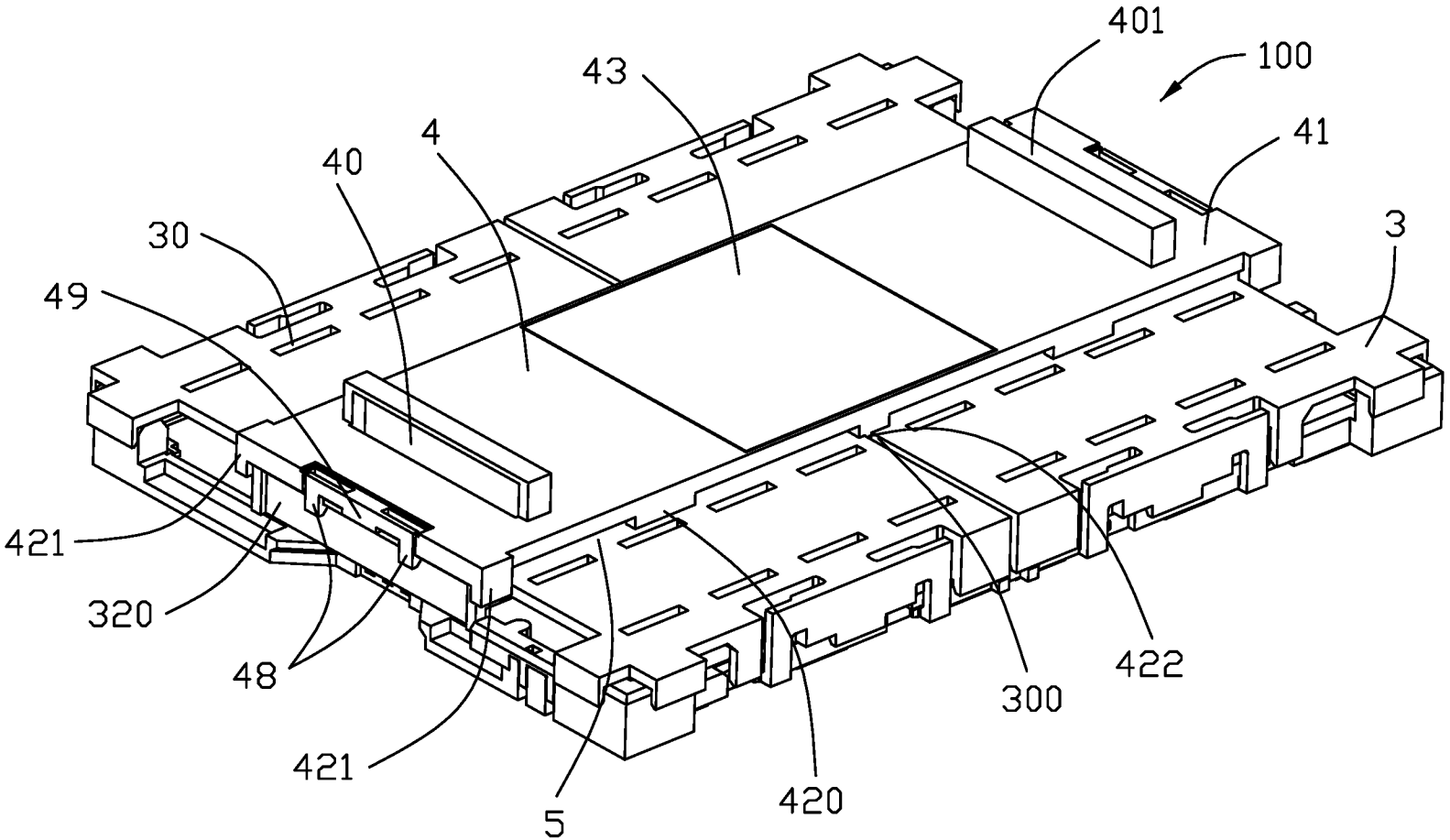
FIG. 1 is a perspective view of an electrical assembly including an electrical connector with the associated paired caps and the linking part in accordance with the first embodiment of the present invention.

Reference will now be made to the drawing figures to describe the present invention in detail.

Figure 2:
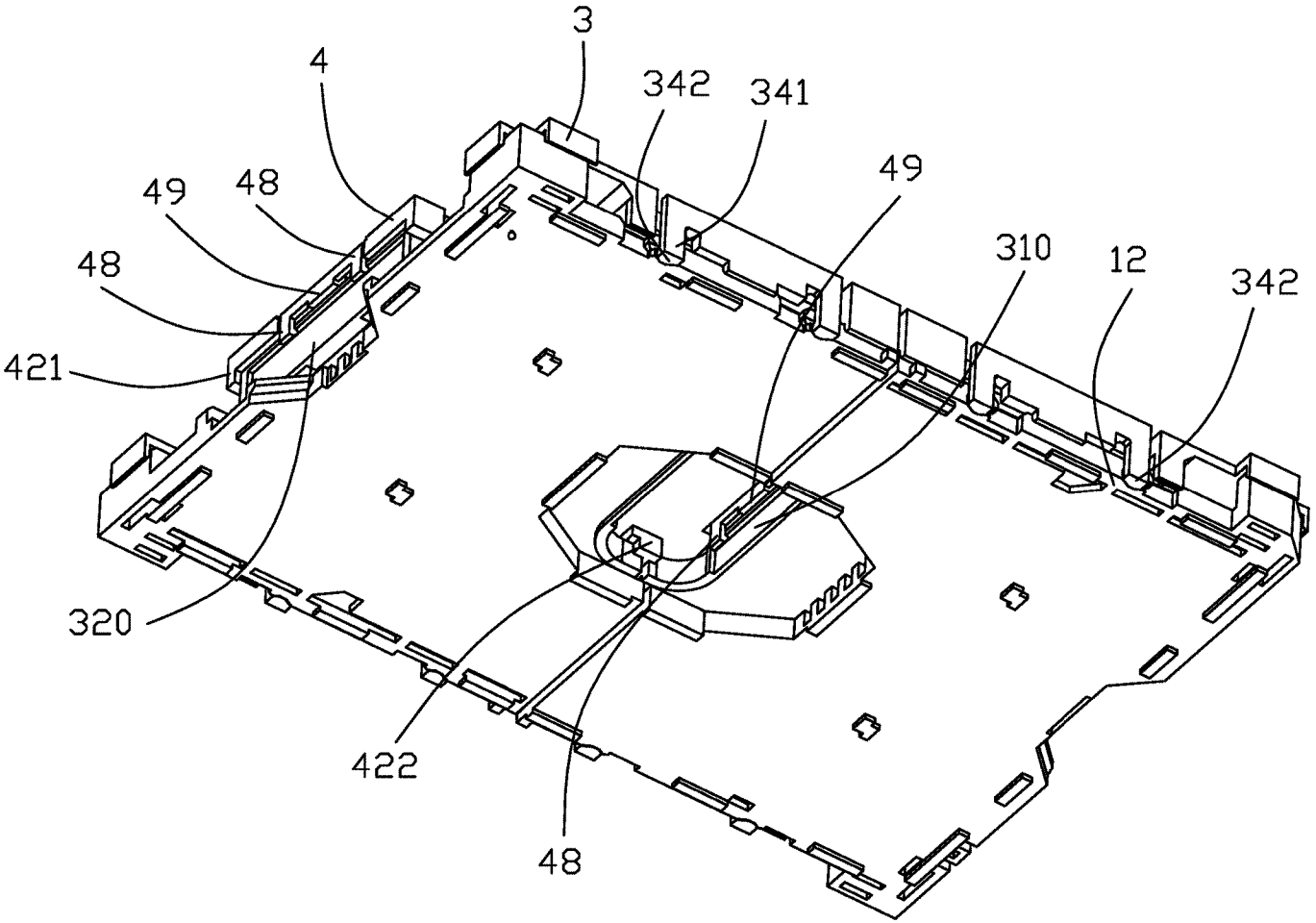
FIG. 2 is another perspective view of the electrical assembly of FIG. 1.
Figure 3:
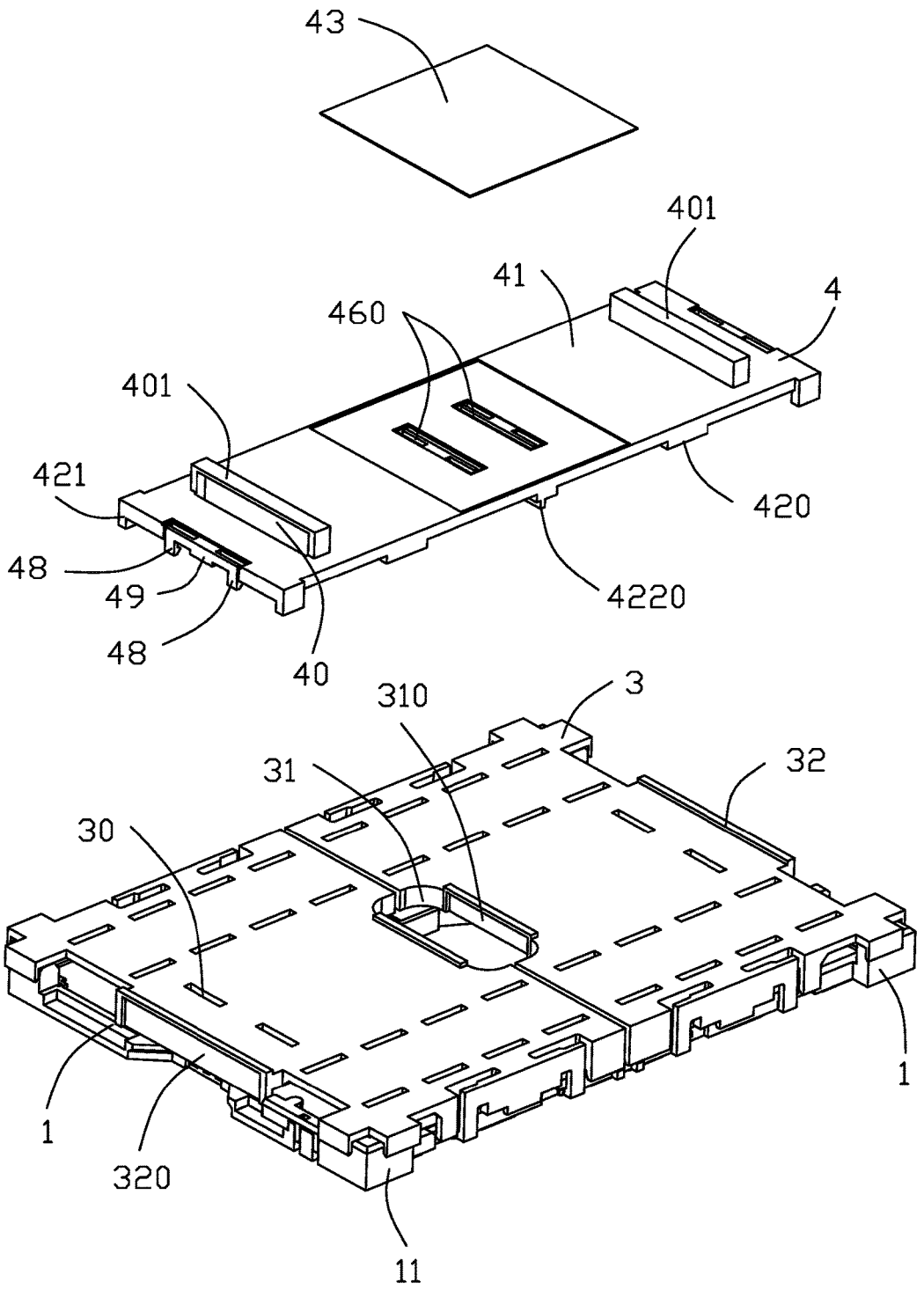
FIG. 3 is an exploded perspective view of the electrical assembly of FIG. 1.
Figure 4:
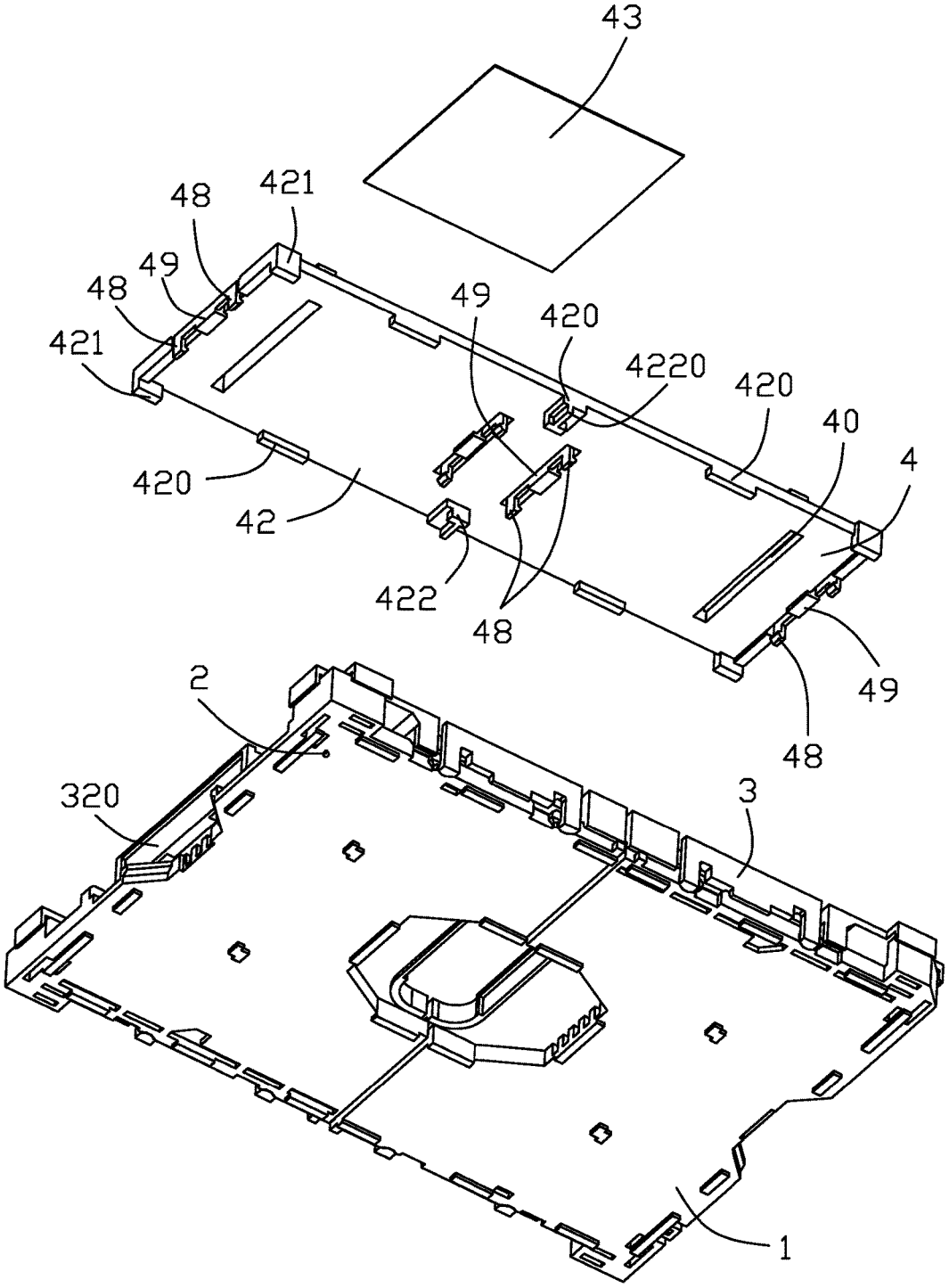
FIG. 4 is another perspective view of the electrical assembly of FIG. 13.
Figure 5:
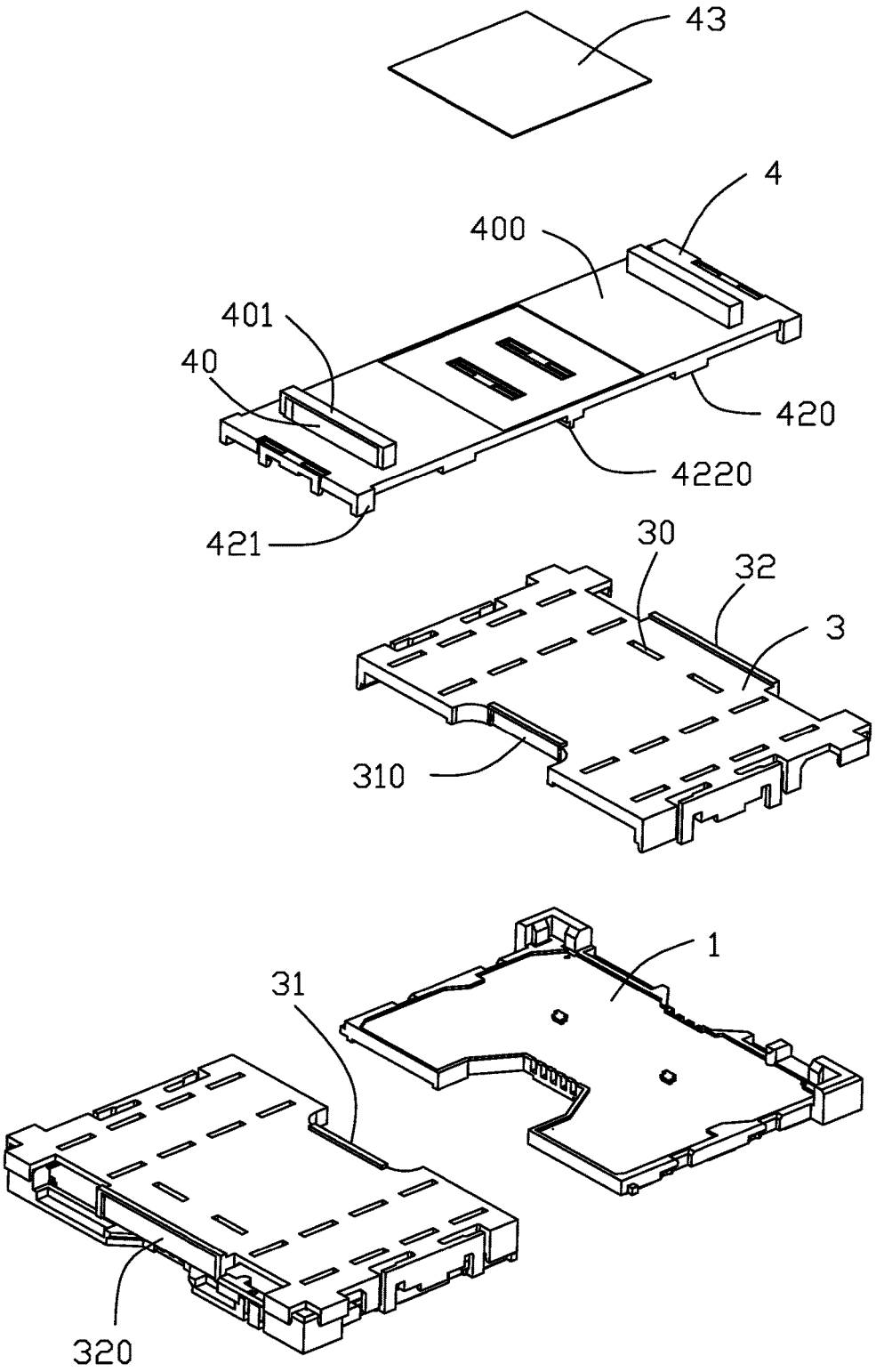
FIG. 5 is a further exploded perspective view of an electrical assembly of FIG. 3.
Figure 6:
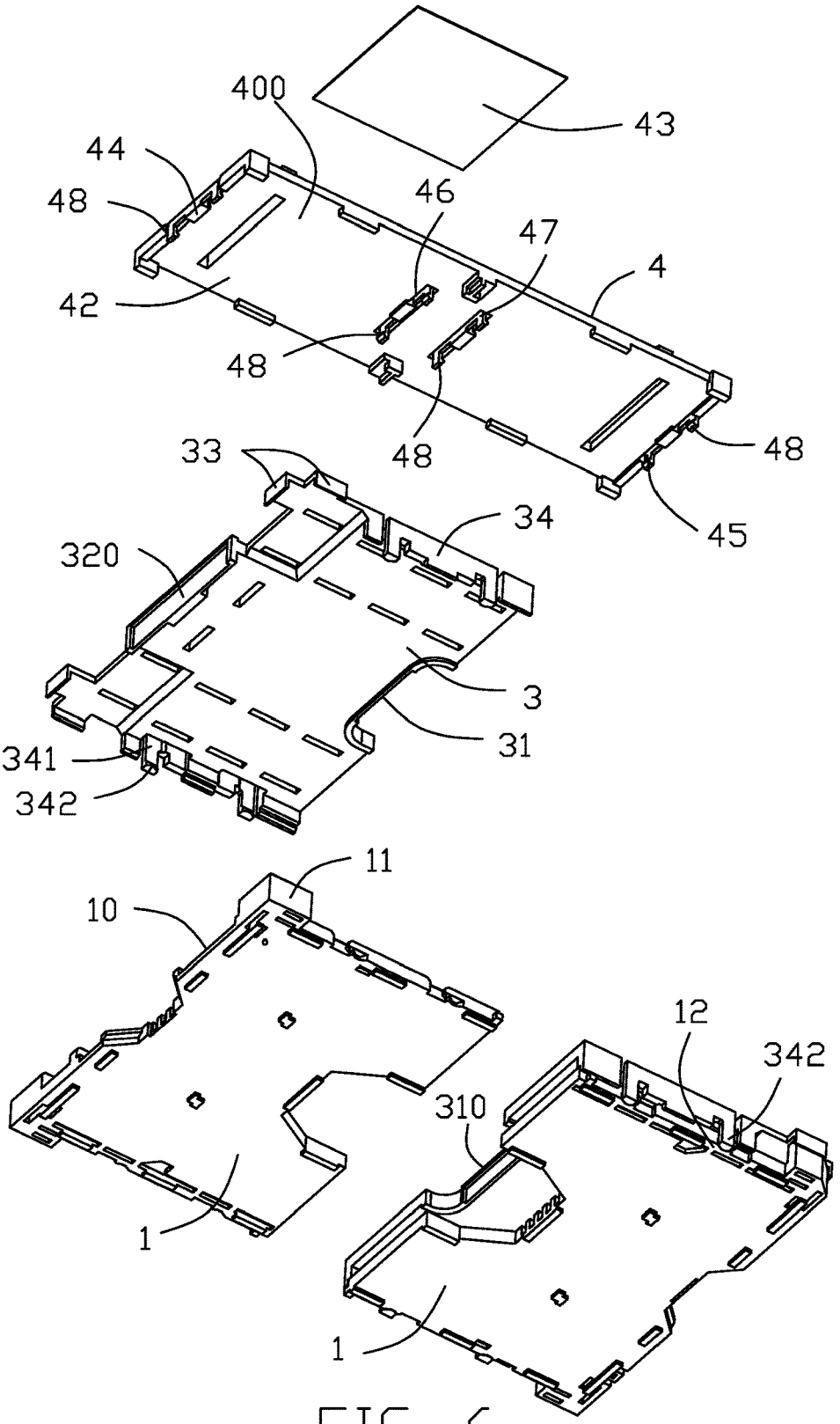
FIG. 6 is another perspective view of the electrical assembly of FIG. 5.

FIG. 1 to FIG. 6 show an electrical connector 100 including a pair of housing units 1, a pair of protection caps 3 respectively mounted upon the corresponding housing units 1 to cover the receiving cavities (not labeled) in the housing units 1 which are to receive a CPU (Central Processing Unit), a plurality of contacts 2 disposed in each housing unit 1 and extending into the corresponding receiving cavity, and a linking part 4. The housing units 1 are side by side arranged with each other viewed in a transverse direction. The cap 3 are respectively mounted upon the corresponding housing units 1 initially in a vertical direction and successively in a horizontal direction while the linking part 4 is mounted upon the pair of caps 3 vertically at the same time. The cap 3 has a plurality of first holes 30 and the linking part 4 has a plurality of second holes 40 corresponding to the first holes 30 for heat dissipation consideration.

In this embodiment, the linking part 4 is rigid and provides the rigid suction region and includes opposite upper suction surface 41 and mounting surface 42. The suction surface 41 is used with the suction nozzle (not shown) for pick-and-place of the whole electrical assembly upon the printed circuit board (not shown). A plurality of standoffs 420 are formed on the mounting surface 42 for spacing the main horizontal plate of the linking part away from the caps 3 with a distance for heat dissipation consideration. A flexible tape is optionally attached upon the linking part 4 around the center region to have the suction nozzle applied thereupon for pick-and-place operation.

The pair of housing units 1 are intimately located with each other with the associated caps 3 mounted thereon, respectively. The pair of caps 3 extends along a longitudinal direction perpendicular to the transverse direction, and has the inner sides 31 adjacent to each other around the center region and the outer sides 32 far away from each other around the two opposite end regions. The linking part 4 has opposite first retainer 44 and second retainer 45 respectively secured to the corresponding outer sides 32, and opposite third retainer 46 and fourth retainer 47 secured to the inner sides 31. Notably, the tape 43 is attached upon the center region of the linking part 4 to cover the corresponding holes 460, which are formed due to mold the third retainer 46 and fourth retainer 47, for assuring the suction function thereof.

The outer side 32 has an outer recess 320 and the inner side 31 has an inner recess 310 for preventing warpage during mounting the socket unit 1 upon the printed circuit board (not shown). Each of the first retainer 44, the second retainer 45, the third retainer 46 and the fourth retainer 47 includes a pair of downwardly extending hooks 48 and a protrusion 49 therebetween in the transverse direction. The hooks 48 are received within the corresponding inner recess 310 or outer recess 320 while the protrusion is located upon the cap 3 so that the hooks 48 cooperate with the protrusion 49 to retain the linking part 4 to the corresponding cap 3 in the vertical direction perpendicular to both the longitudinal direction and the transverse direction. A plurality of blocks 421 are formed on the linking part 4 to retain the linking part 4 to the cap 3 in the transverse direction.

A limiting block 422 is formed on the corresponding center standoff 420 with the limiting rib 4220 which is essentially located at the boundary region 300 between the pair of caps 3 in the longitudinal direction. A pair of grasping sections 401 are formed on the suction surface 41 so as to facilitate assembling or disassembling of the linking part 4 with regard to the corresponding caps 3.

The housing units 1 form outer sides 10 and the L-shaped blocks 11 at four corners. The cap 3 forms a first limiting side 33 cooperating with the block 11 for restraining the cap 3 with regard to the corresponding housing unit 1. The cap 3 further forms a second limiting side 34 having the vertical section 341 and the horizontal section 342 extending from a bottom end of the vertical section in the transverse direction and received within the corresponding locking groove 12 of the housing unit 1 after then cap 3 is completely assembled to the housing unit 1 so as to assure retention between the cap 3 and the housing unit 1 in the vertical direction.

In this embodiment, the cap 3 is assembled to the corresponding housing unit 1 initially downwardly in the vertical direction and successively horizontally in a longitudinal direction from an outer position to an inner position. Notably, the pair of caps 3 are assembled to the corresponding pair of housing units 1 in opposite directions toward each other from the outer position to the inner position along said longitudinal direction. The linking part 4 is downwardly assembled to both the pair of caps 3 simultaneously in the vertical direction. The rigid suction area is provided by the linking part 4. Compared with the aforementioned U.S. Pat. No. 9,385,444, the invention provides an auxiliary linking part 4 for unifying the separate connector units, i.e., the respective housing units 1 and associated caps 3 for facilitating shipping and mounting the connector units efficiently.

Figure 7:
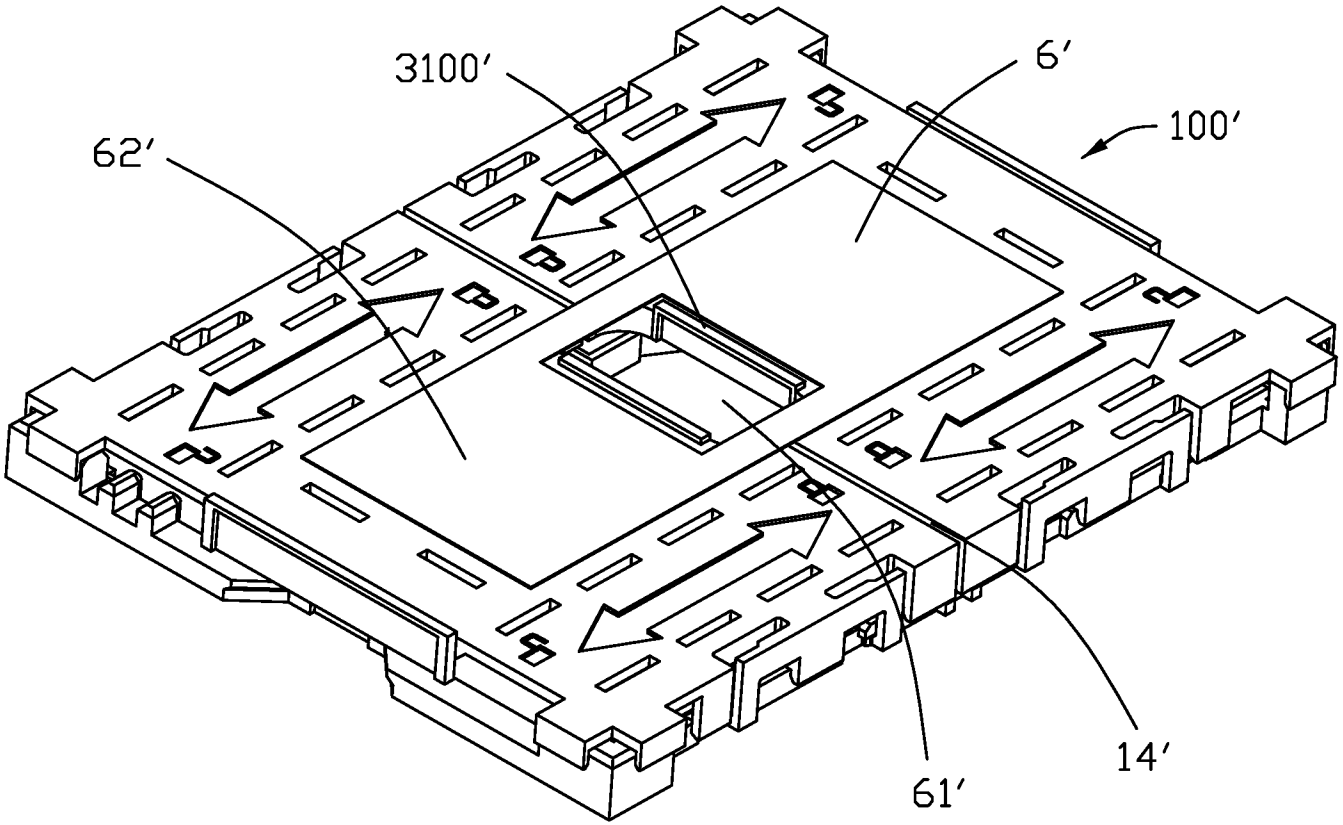
FIG. 7 is an assembled perspective view of an electrical assembly including an electrical connector, the associate paired caps and the linking part according to the second embodiment of the invention.
Figure 8:
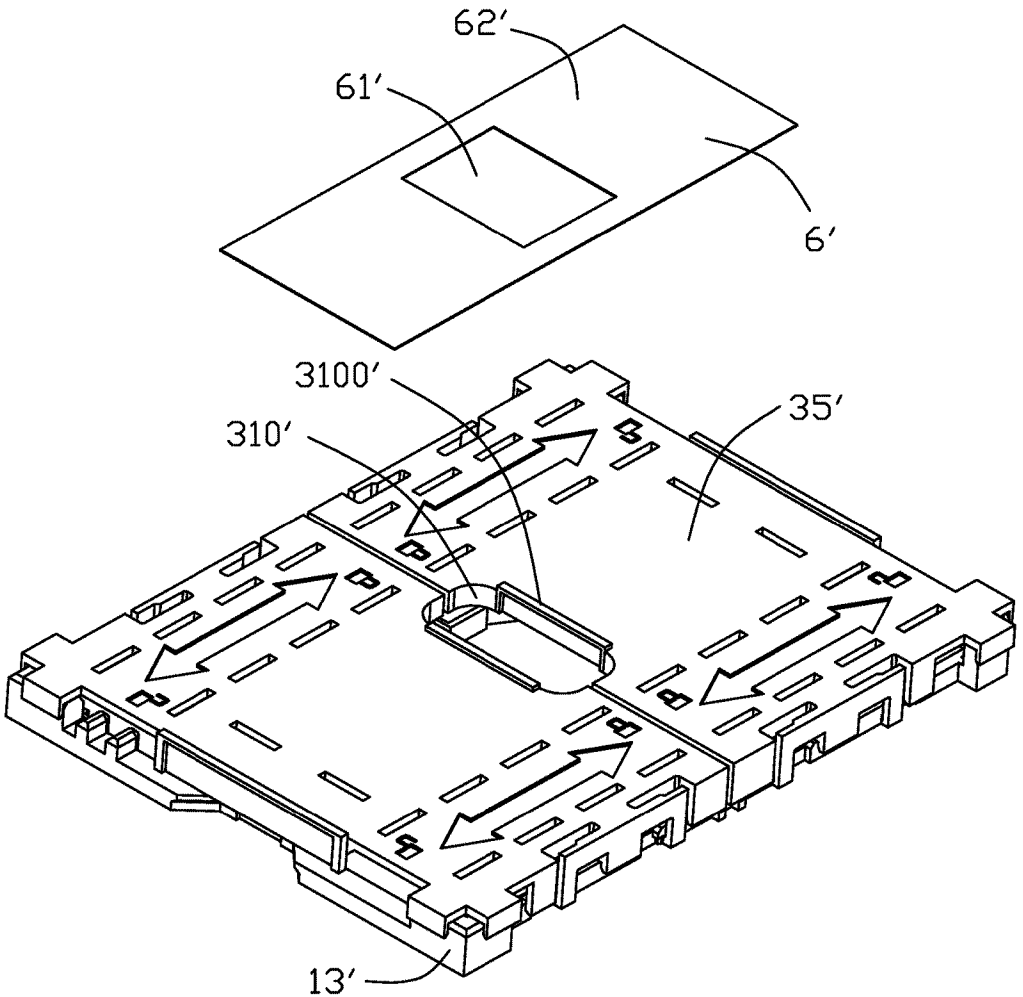
FIG. 8 is an exploded perspective view of the electrical assembly of FIG. 7.
Figure 9:
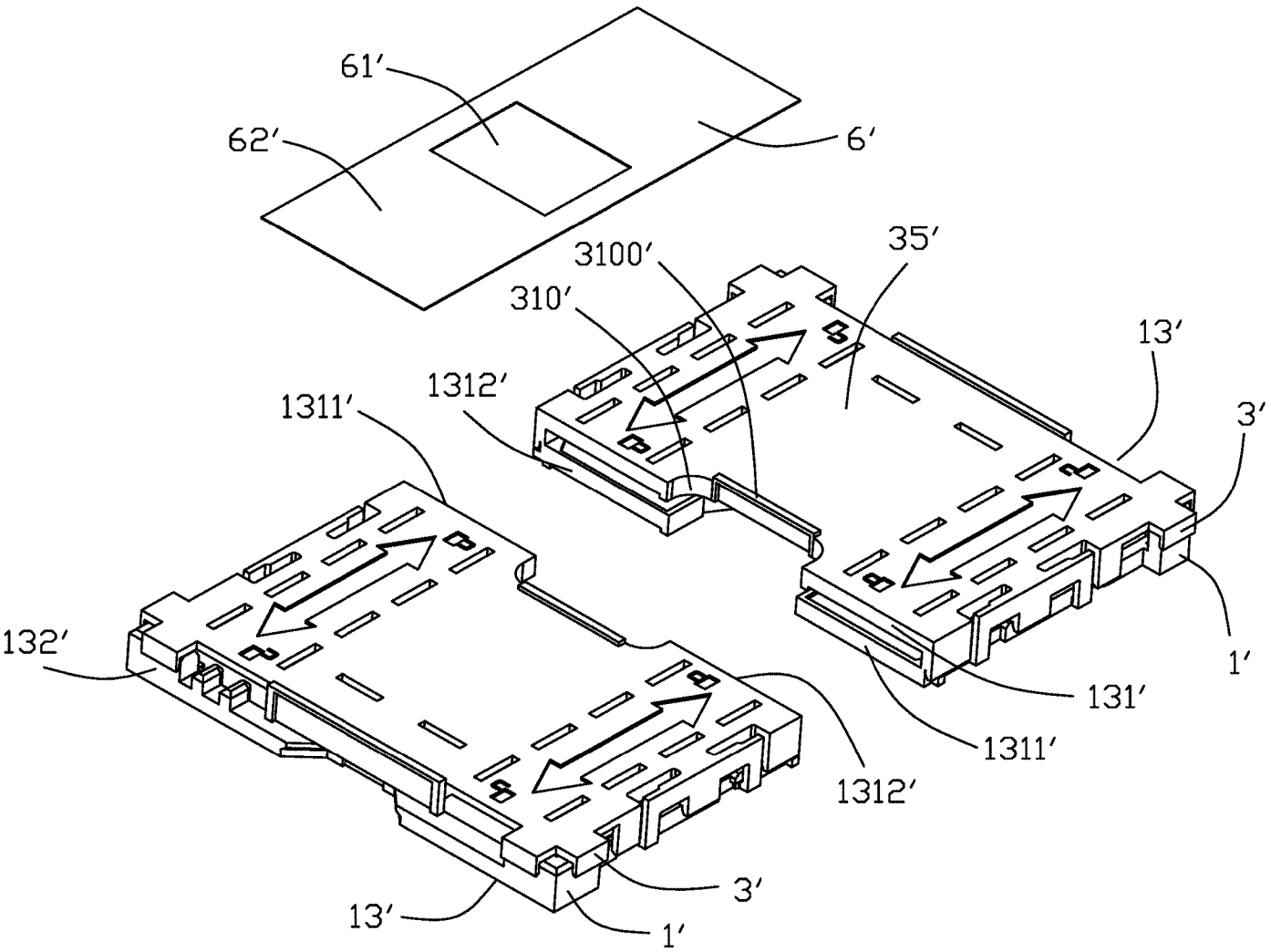
FIG. 9 is a further exploded perspective of the electrical assembly of FIG. 8.
Figure 10:
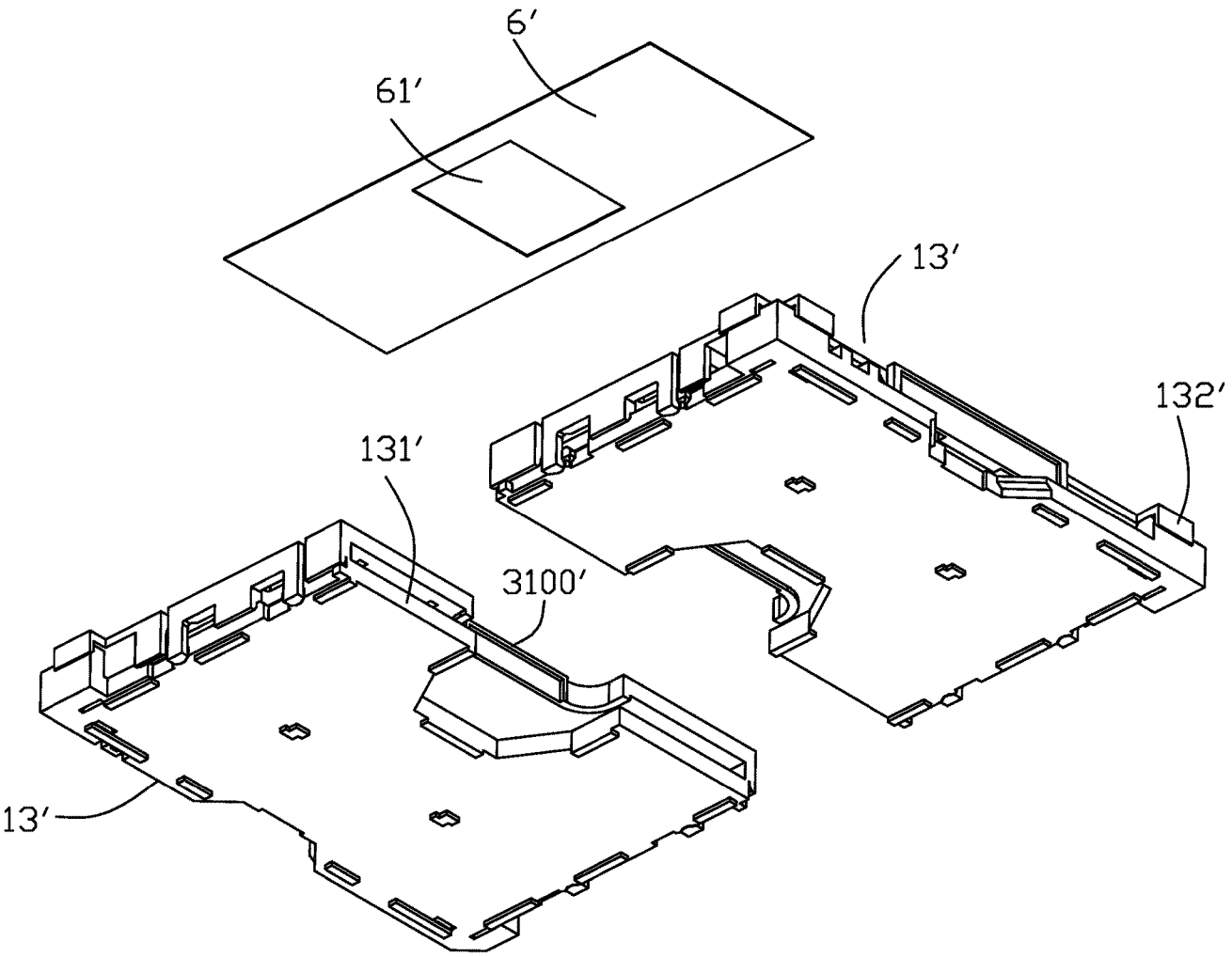
FIG. 10 is another perspective view of the electrical assembly of FIG. 9.
Figure 11:
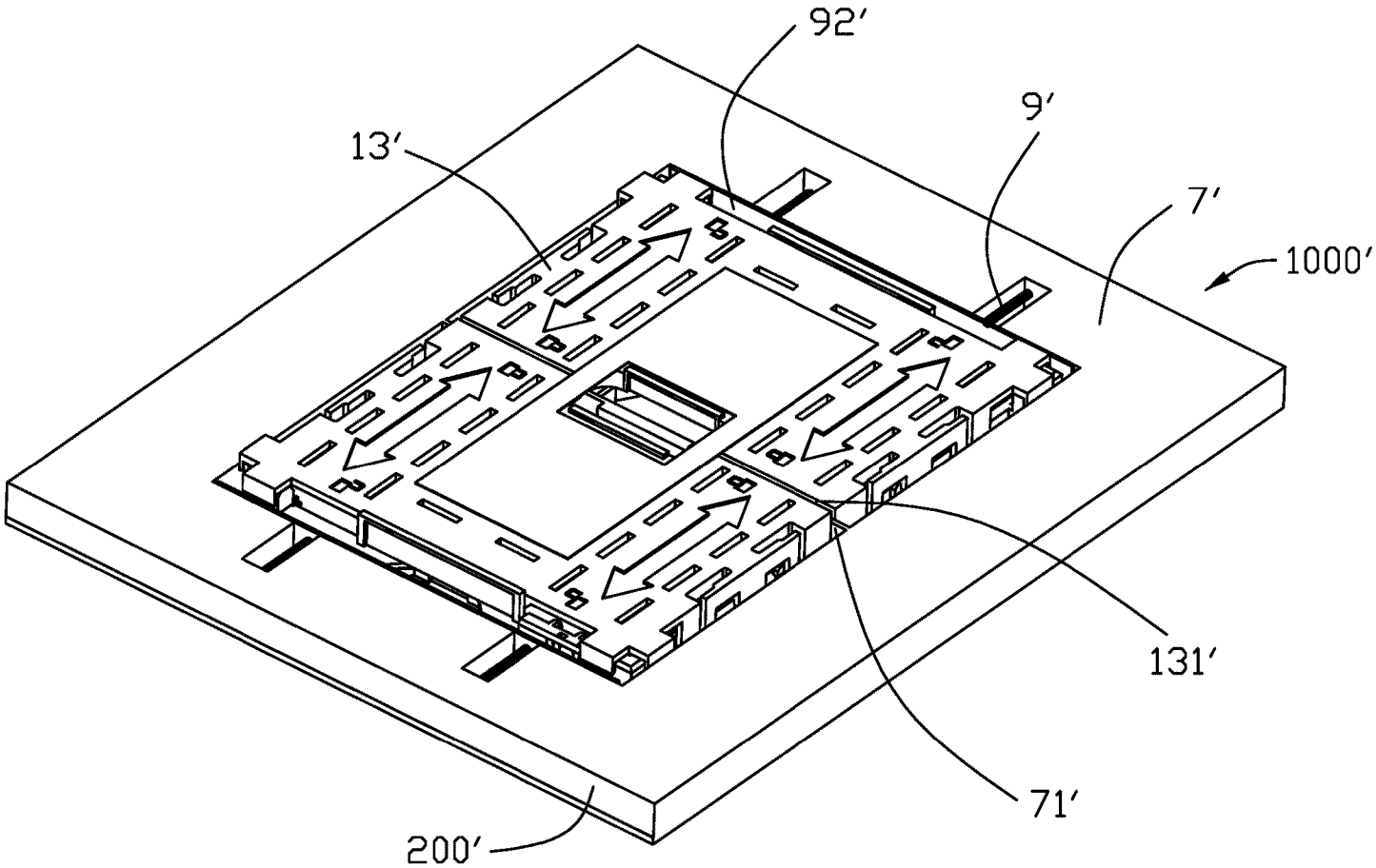
FIG. 11 is a perspective view of the electrical assembly of FIG. 7 loaded with a fixture.
Figure 12:
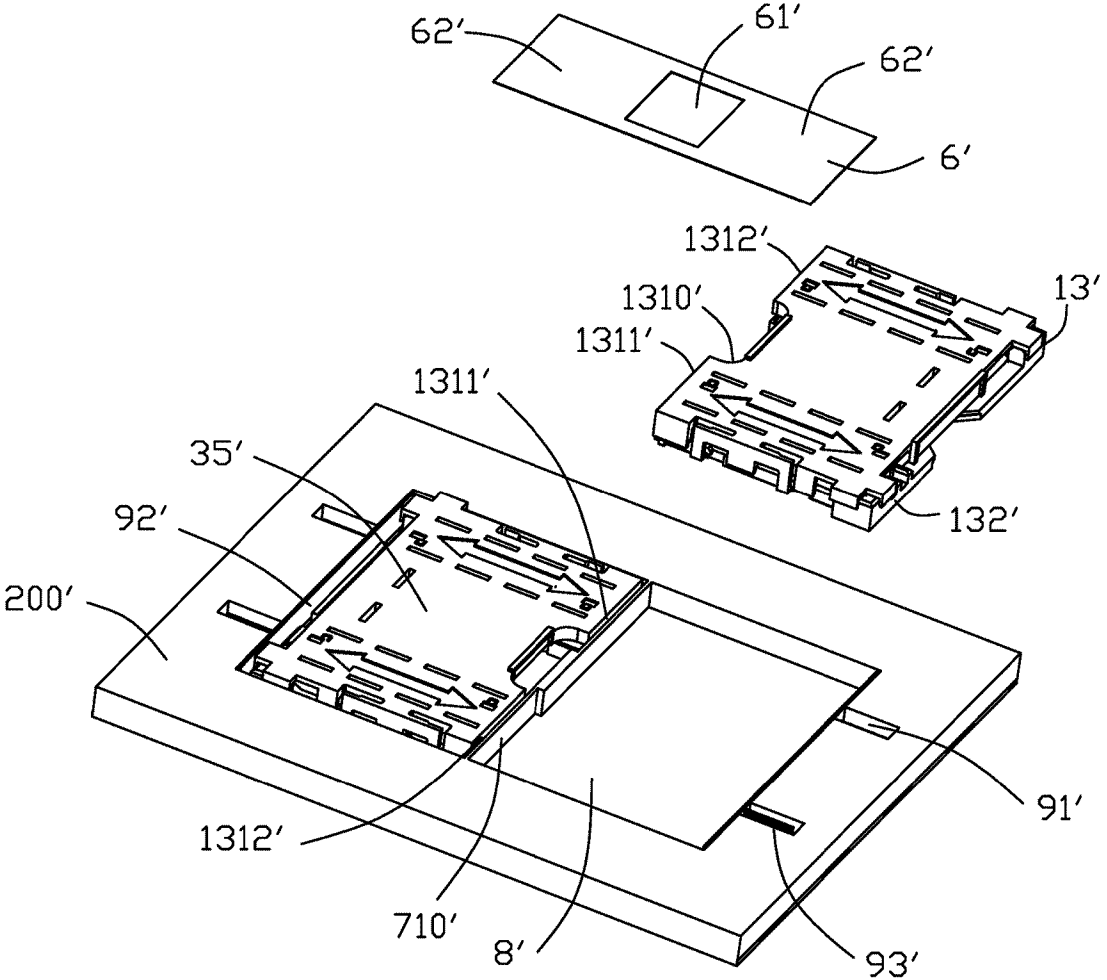
FIG. 12 is an exploded perspective view of the electrical assembly and the fixture of FIG. 11.
Figure 13:
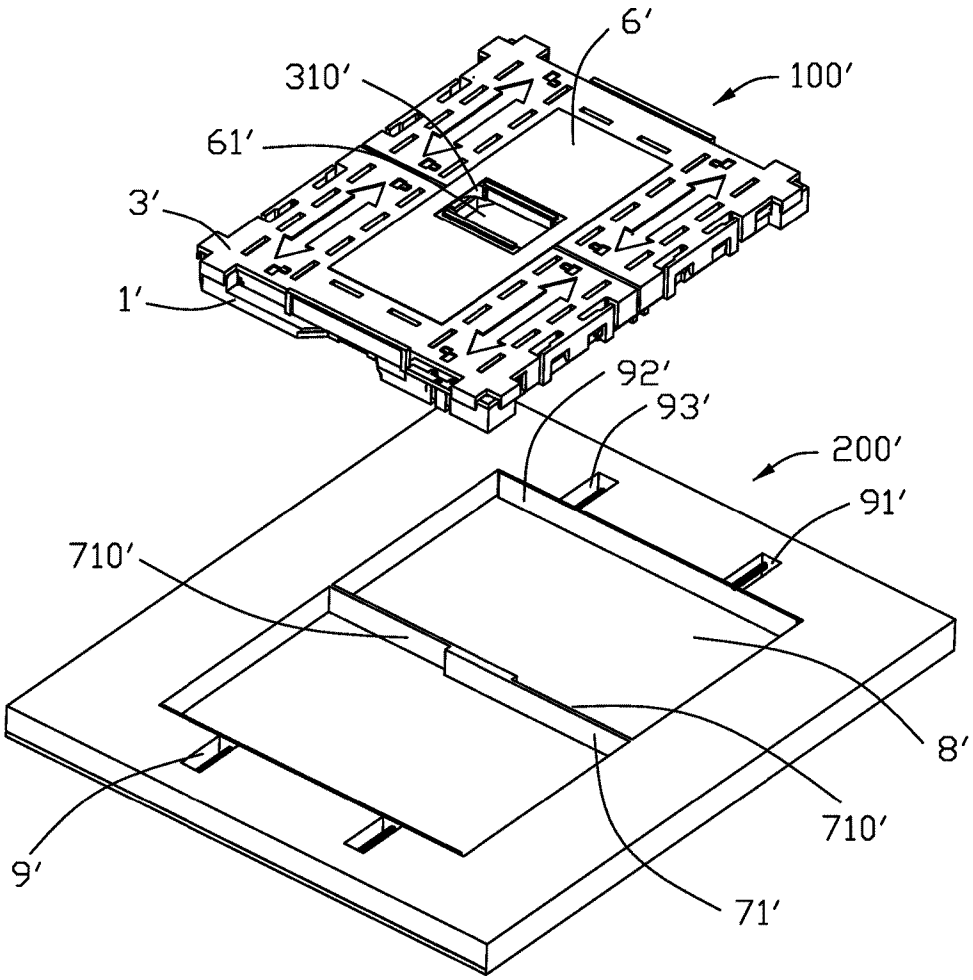
FIG. 13 is a perspective view of the electrical assembly and the fixture of FIG. 11 in a spaced manner.

Referring to FIGS. 7-13 showing another embodiment, an electrical assembly 1000' includes an electrical connector 100' and a fixture 200' to assemble the plural connector units of the electrical connector 100' which is mounted upon a printed circuit board (not shown) for connecting to a central processing unit (not shown). The connector 100' has two housing units 1', a pair of caps 3' respectively mounted upon the corresponding housing units 1', and a plurality of contacts (not labeled) in each housing unit 1'. The housing units 1' are side by side arranged with each other viewed in the transverse direction. The housing unit 1' with the corresponding contacts (not labeled) therein commonly form a connector unit 13'. A gap is formed between two connector units 13' in the longitudinal direction perpendicular to the transverse direction. A linking part 6' in a form of flexible tape is attached upon both the caps 3'. Similar to the first embodiment, the caps 3' are finally horizontally assembled to the corresponding housing unit 1' while the tape like linking part 6' is vertical attached to or detached from the caps 3'. Therefore, the detachment of the linking part 6' from the caps 3' will not influence retention between the housing unit 1 and the corresponding cap 3'.

The connector units 13' are intimately side by side disposed with each other. The cap 3' forms an inner recess 310' in the inner side (not labeled), and a rib 3100' extending from the inner recess 310'. The cap 3' forms a rigid suction region 35 on which the tape like linking part 6' is attached.

The linking part 6' extends along the longitudinal direction, including an opening 61' corresponding to the inner recess 310', and a pair of suction areas 62' by two sides of the opening 61' wherein the suction areas 62' are attached upon the corresponding rigid suction regions 35' and the rib 3100' is received within the opening 61'. Understandably, in the first embodiment, only one suction region/area is formed on the linking part 4' while in this embodiment there are two suction regions/areas located by two sides of the opening 61'. In other words, in the first embodiment only one suction nozzle is used while in the second embodiment the dual-suction nozzle is used for complying with the two suction regions/areas.

In this embodiment, the tape/film like linking part 4' is of Polyimide for superior characteristics of heat resistance, anti-chemical corruption and mechanical strength.

In this embodiment, the fixture 200' includes an insulative body 7' and a pair of receiving rooms 8' side by side formed in the body 7' with a divider 71' therebetween viewed in the transverse direction, and a pair of urging devices 9' located by two opposite ends of the pair of receiving rooms 3' in the longitudinal direction. The connector unit 13' is received within the corresponding receiving room 3' and includes an inner side 131' and an outer side 132'. The urging device 9' pushes the outer side 132' of the connector unit 13' until the corresponding inner side 131' abuts against the divider 71'. Understandably, the divider 71' is to form the gap 14' between the pair of connector units 13', having the function similar to the limiting rib 4220 in the first embodiment.

The inner side 131' of the connector unit 13' includes an inner recess 1310' and opposite first inner section 1311'and second inner section 1312' by two sides of the inner recess 1310 wherein the first inner section 1311' protrudes beyond the second inner section 1312'. Correspondingly, a recession 710' is formed in each receiving room 8' to receiving the first inner section 1311' of the corresponding connector unit 13'.

The urging device 9' forms a passageway 91' in communication with the receiving room 8', a pushing plate 92' urged by the spring 93' which is received within the corresponding passageway 91', so as to constantly pushing the outer side 132'. As a result, the first inner section 1311' and the second inner section 1312' may precisely and intimately confront the divider 71', thus assuring correctness when attaching the tape like linking part 4' to the corresponding caps 3'.

It is noted that the pair of housing unit 1 or 1' are essentially similar to each other but arranged in an opposite and symmetrical manner wherein one outer corner of only one housing unit 1 or 1' is chamfered (not labeled) for the orientation purpose during mounting the whole connector assembly upon the printed circuit board.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical assembly comprising:

a pair of insulative housing units side by side arranged with each other viewed in a transverse direction, each of said housing units forming an upward opening receiving cavity;

a plurality of conductive contact disposed in each of said housing units;

a pair of caps attached upon the corresponding housing units to cover the corresponding receiving cavities, respectively; and a linking part attached upon the pair of caps; wherein said linking part is rigid and provides a flat suction region thereon for suction purpose; wherein said linking part includes means for vertically assembled to the caps to retain the linking part to the pair of caps; wherein each of said caps includes means for horizontally assembling to the corresponding housing unit with vertical retention thereof; further including a flexible tape attached upon the linking part; wherein said linking part forms a hole in alignment with a retainer secured to the corresponding cap, and said tape covers said hole.

2. The electrical assembly as claimed in claim 1, wherein at least one of said linking part and said caps forms standoffs to vertically space a horizontal main plate of the linking part away from the caps.

3. The electrical assembly as claimed in claim 2, wherein said linking part further forms a pair of grasping sections opposite to the standoffs in a vertical direction perpendicular to said transverse direction.

4. The electrical assembly as claimed in claim 1, wherein a gap is formed between the pair of housing units viewed in the transverse direction, and said linking part includes a limiting rib inserted into another gap which is formed between the pair of caps viewed in the transverse direction and aligned with the gap in the vertical direction.

5. The electrical assembly as claimed in claim 1, wherein both said caps and said linking part form corresponding through holes for heat dissipation.

6. The electrical assembly as claimed in claim 1, wherein the linking part further includes a pair of grasping sections.

7. The electrical assembly as claimed in claim 1, wherein said linking part is flexible in a tape like form, and the pair of caps provide two opposite corresponding suction regions symmetrically located by two sides of a center region of the linking part.

8. The electrical assembly as claimed in claim 1, wherein only one of the housing units forms a chamfered structure on a corner which is located on an outer side edge.

9. The electrical assembly as claimed in claim 1, wherein each of said caps defines an inner side and an outer side spaced from each other along a longitudinal direction perpendicular to said transverse direction, and the linking part include opposite retainers respectively secured to the inner side and the outer side of the corresponding cap.

10. The electrical assembly as claimed in claim 1, further including a fixture forming a pair of receiving rooms with a divider therebetween in a longitudinal direction perpendicular to said transverse direction to respectively receive the pair of housing units with the associated caps.

11. The electrical assembly as claimed in claim 10, wherein said fixture further includes a spring constantly urging the cap in the longitudinal direction for assuring said cap to be precisely assembled to the corresponding housing unit.

12. The electrical assembly as claimed in claim 1, wherein each of said caps defines an inner side and an outer side spaced from each other along a longitudinal direction perpendicular to said transverse direction, and the inner side forms an inner recess to cooperate with the linking part for alignment consideration.

13. The electrical assembly as claimed in claim 12, wherein said linking part is rigid and forms a downward extending hook engaged within the inner recess.

14. The electrical assembly as claimed in claim 12, wherein the linking part is flexible and forms an opening to receive a rib formed on the cap around the inner recess.

15. The electrical assembly as claimed in claim 1, wherein in a longitudinal direction perpendicular to said transverse direction, a dimension of said linking part is roughly equal to a sum of said pair of housing units.

* * * * *